US010165851B1

(12) United States Patent
Downs

(10) Patent No.: US 10,165,851 B1
(45) Date of Patent: Jan. 1, 2019

(54) ACCESSORY HOLDER

(71) Applicant: Matthew J Downs, Washington, DC (US)

(72) Inventor: Matthew J Downs, Washington, DC (US)

( * ) Notice: Subject to any disclaimer, the term of this patent is extended or adjusted under 35 U.S.C. 154(b) by 0 days.

(21) Appl. No.: 15/616,683

(22) Filed: Jun. 7, 2017

(51) Int. Cl.

| | |
|---|---|
| ***A45F 5/02*** | (2006.01) |
| ***F21V 17/10*** | (2006.01) |
| ***F21V 33/00*** | (2006.01) |
| ***F21V 21/14*** | (2006.01) |

(52) U.S. Cl.
CPC ..... *A45F 5/021* (2013.01); *F21V 17/107* (2013.01); *F21V 21/14* (2013.01); *F21V 33/0008* (2013.01)

(58) Field of Classification Search
CPC ..... A45F 5/021; A45F 2005/025–2005/026; A45F 2200/0575; A45F 2200/0508; A45F 2200/0516; Y10S 224/904; F41C 33/041; F41C 33/045; F21V 33/0008
USPC ..... 224/666–673, 904, 660, 662, 63, 665, 224/197–200, 271
See application file for complete search history.

(56) References Cited

U.S. PATENT DOCUMENTS

| | | | | |
|---|---|---|---|---|
| 5,375,749 | A * | 12/1994 | Oliva | A45F 5/02 224/242 |
| 2006/0237494 | A1* | 10/2006 | Fichera | A45F 5/02 224/197 |
| 2007/0262112 | A1* | 11/2007 | Butler | A45C 11/182 224/669 |
| 2012/0325882 | A1* | 12/2012 | Tages | A45F 5/021 224/676 |

* cited by examiner

*Primary Examiner* — Scott McNurlen

(57) ABSTRACT

A device for attachment to a belt for holding an accessory having a base, a front surface and a back surface, the base having belt receiving slots and the front surface of said base having a right side and a left side wherein said left side of said base having a first retaining portion extending substantially perpendicularly to said front wall and said first retaining portion having a first sidewall extending therefrom substantially parallel to and spaced from said front surface and forming a first recess and said right side of said base having a second retaining portion extending substantially perpendicularly to said front wall and said second retaining portion having a second sidewall extending therefrom substantially parallel to and spaced from said front surface and forming a second recess and a release member formed as part of said base.

8 Claims, 5 Drawing Sheets

ACCESSORY HOLDER

FIELD OF THE INVENTION

The present invention relates generally to accessory holders, and more specifically, to accessory holders for attachment to a user's belt.

BACKGROUND OF THE INVENTION

Accessory holders for connecting to straps and belts allow a person to carry devices and tools while keeping their hands free. In particular, having a light source located in a position to illuminate one's path for walking without the need for using a handheld flashlight provides convenience and safety. However, a holder for such a device or other accessory which can securely lock said device or accessory in position but allows it to be unlocked and detached offers an additional advantage. For example, when using a flashlight or lamp such as a headlamp attached to the belt of a backpack, it is advantageous to have a lamp that can be easily removed to replace batteries or to hold the light in your hand without removing your backpack. Additionally, when the holder is attached to the belt, a lamp can be easily attached if needed without taking off the backpack or unbuckling the belt.

Personal headlamps as light sources are useful and common in providing a convenient, portable light source that can be fixed in position on one's forehead without the need for hands. Such headlamps have a light source attached to a small, usually plastic piece via a hinge. An elastic cloth band is then affixed to this plastic headpiece which enables the user to strap the headlamp to his or her forehead where it will remain in position and direct light in the same direction as the user's face is directed. The hinge allows the user to direct the light up and down from that position.

An accessory holder mounted to a strap or belt and uniquely designed to securely but detachably carry headlamps would offer headlamp users additional options for fixing in position their headlamps. With such an accessory holder, users would have the option to wear their headlamp on the forehead, as designed, or worn at hip level on a belt, or at chest level on a backpack sternum strap, for example.

Such an accessory holder offers several advantages to the headlamp user. First, headlamps are often rendered uncomfortable, awkward or useless in the event a user must also wear a head cover such as a helmet, gas mask, beanie or ball cap. A headlamp accessory holder on the user's belt would allow the user to maintain hands-free illumination while wearing such head covers.

In addition, when fixed to an accessory holder at the user's hip or chest, a headlamp would permit the user to move his or her head to the side, up and down without thereby changing the direction of the light. For users hiking at night, for example, this option would be useful in maintaining trail illumination regardless of which way the hiker's head turns.

A light source mounted at the hip or chest level would shorten the light beam and spill less light into the environment than one mounted higher, i.e., on the user's forehead. Less light spillage would make the user less visible at night to others. In tactical military night applications, for example, less visibility may be critical.

In addition, a headlamp mounted at the hip or chest level with the ability to rotate the direction of the light downward could be important to users descending stairs in a power outage or a steep trail in the dark. A light source located closer to the ground than the user's head would illuminate the user's immediate path in front with a shorter light beam and less neck strain.

OBJECTS AND SUMMARY OF THE INVENTION

An object of the invention is to provide a holder for attachment to a belt or strap for retaining an accessory:

Another object of the invention is to provide a holder for attachment to a belt for holding a lamp;

Still another object of the invention is to provide a holder having a release mechanism for releasably engaging a lamp housing.

Yet another object of the invention is to form the release mechanism as a unitary part of the base of the holder;

Still another object of the invention is to form the holder of a unitary single material that is sufficiently rigid to support a lamp housing, yet having elastic flexibility to enable a release mechanism to flex and releasably engage a lamp housing.

In summary, the invention in a preferred embodiment is directed to a device for attachment to a belt for holding an accessory, comprising a holder having a base having a front surface and a back surface, the back surface having connected thereto at least one slot-forming member adapted to receive a belt and the front surface of said base having a right side and a left side wherein said left side of said base having a first retaining portion extending substantially perpendicularly to said front wall and said first retaining portion having a first sidewall extending therefrom substantially parallel to and spaced from said front surface and forming a first recess and said right side of said base having a second retaining portion extending substantially perpendicularly to said front wall and said second retaining portion having a second sidewall extending therefrom substantially parallel to and spaced from said front surface and forming a second recess and a release member formed as part of said base; wherein said release member includes a catch for engaging an accessory.

Alternatively, the invention is directed to a device for attachment to a belt for holding a light, comprising a holder having a base having a front surface and a back surface and said back surface having connected thereto at least one slot-forming member adapted to receive a belt and said front surface of said base having a right side and a left side wherein said left side of said base having a first retaining portion extending substantially perpendicularly to said front wall and said first retaining portion having a first sidewall extending therefrom substantially parallel to and spaced from said front surface and forming a first recess and said right side of said base having a second retaining portion extending substantially perpendicularly to said front wall and said second retaining portion having a second sidewall extending therefrom substantially parallel to and spaced from said front surface and forming a second recess and a release member formed as part of said base wherein said release member includes a catch for engaging a portion of a light.

The invention will become more fully apparent from the claims and the description in connection with the drawings.

DETAILED DESCRIPTION OF THE INVENTION

Figure 1:
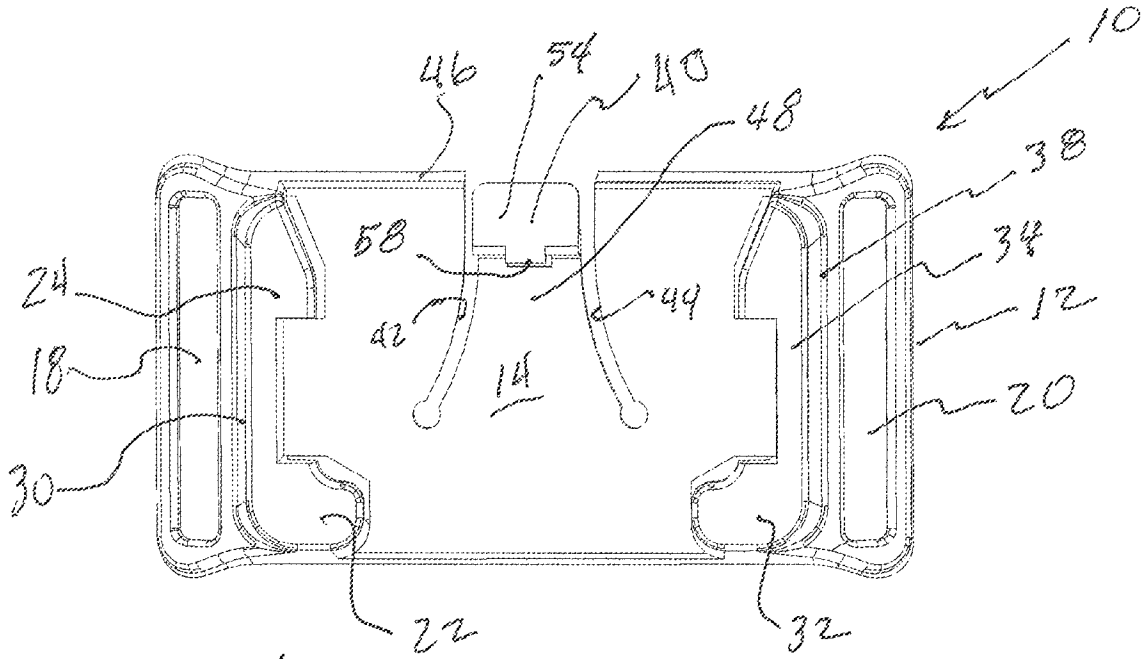
FIG. 1 is a front elevational view of a preferred embodiment of the holder.
Figure 2:
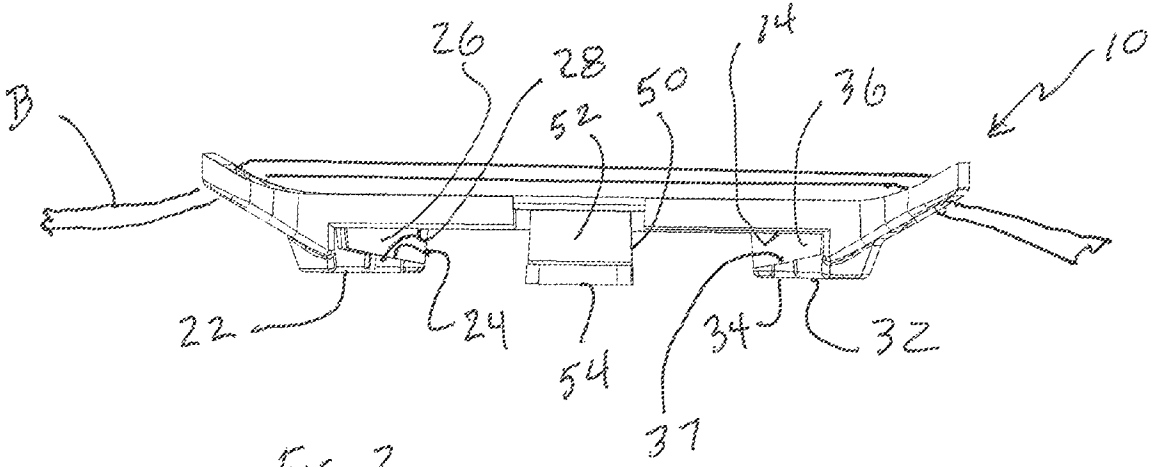
FIG. 2 is a top plan view of the holder of FIG. 1.
Figure 3:
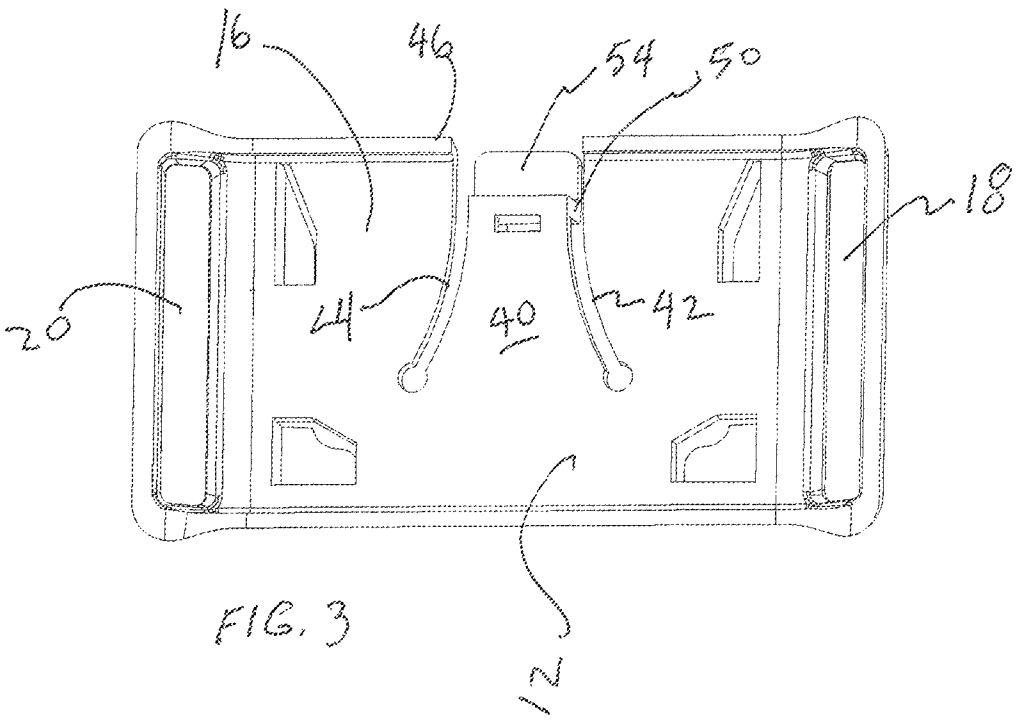
FIG. 3 is a rear perspective view of the holder of FIG. 1.

As depicted in FIG. 1, FIG. 2 and FIG. 3 the holder 10 includes a base member 12 having a front surface 14 and a back surface 16. The generally flat base member 12 includes a pair of belt attaching slots 18 and 20 on the left and right sides, respectively for receiving a belt or strap B which can be slid through the slots 18 and 20 and pass along the back surface 16.

Extending outwardly from the front surface 14 is a left side retaining portion 22 having a sidewall 24 extending substantially parallel to the front surface 14 to form a recess 26 between the front surface 14 and the inner portion 28 of the sidewall 24. A connecting step 30 joins the sidewall 24 to the front surface 14.

A right side retaining portion 32 also extends outwardly from the front surface 14 and includes a sidewall 34 extending substantially parallel to the front surface 14 to form a recess 36 between the front surface 14 and inner portion 37 of sidewall 32. A connecting step 38 joins the sidewall 32 to the front surface 14.

The holder 10 is preferably formed of a resilient material such as plastic or metal. If the holder 10 is formed of plastic material it can be manufactured by injection molding preferably using ABS but other suitable plastic material may be used. The base member 12 includes a release member 40 preferably formed as part of the base member 12. The release member 40 is formed by creating two spaced apart slots 42 and 44 in the base member 12 which extend from the top edge 46. The release member 40 includes a release actuating flange 48 formed between the slots 42 and 44 and preferably includes an L-shaped stepped portion 50 having a first wall 52 extending outwardly and a second wall 54 extending upwardly and generally parallel to the generally flat base member 12 such that a corner 56 is formed at the junction of the first wall 52 and the second wall 54. A catch member 58 forms a small ridge that extends downwardly from the corner 56.

Figure 4:
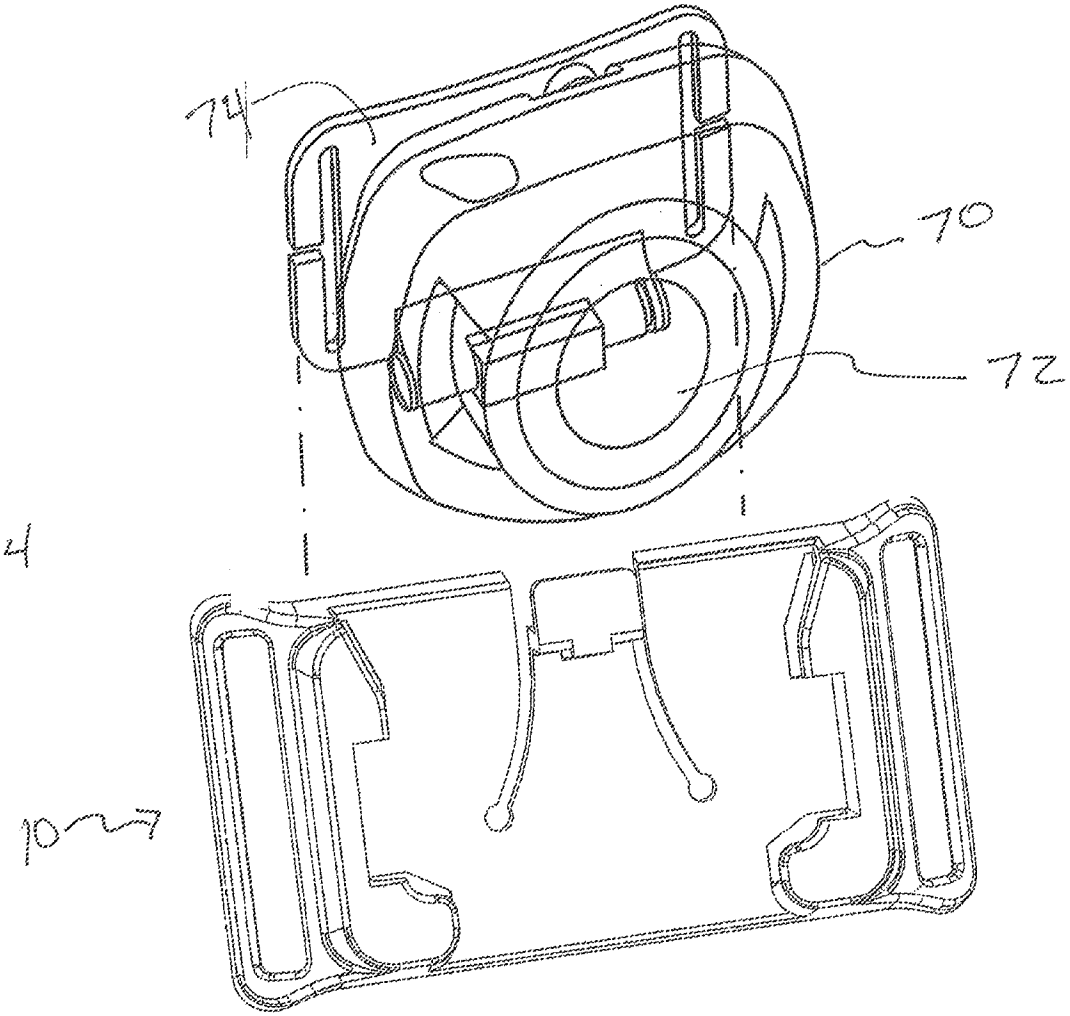
FIG. 4 is front perspective view of the holder of FIG. 1 and a lamp.

FIG. 4 shows a lamp 70 for insertion into the recesses 26 and 36. Preferably, the lamp 70 includes a light emitting portion 72 that is hingedly connected to a lamp support base 74.

Figure 5:
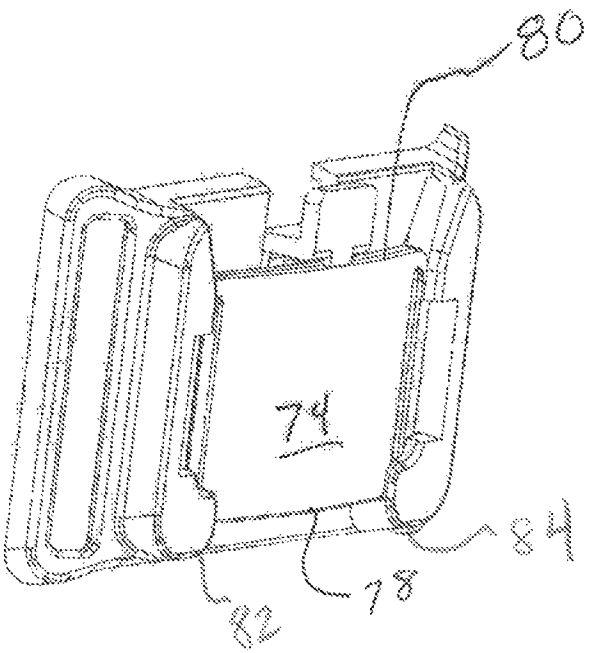
FIG. 5 is a perspective view of the holder of FIG. 1 retaining a lamp connector.

FIG. 5 illustrates the lamp support base 74 attached to the holder 10. When the support base 74 is inserted into the recesses 26 and 36, the lower portion 78 of the support base 74 slides down and causes the release member 40 to flex backward. When the upper portion 80 of the support base 74 passes over the retainer 58, the release member 40 springs forward and the retainer 58 slides over the upper portion 80 of the support base 74 and the support base 74 is locked from moving vertically by the wall 52. The lamp support base 74 rests on steps 82 and 84 which prevent the lamp support base from sliding out of the recesses 26 and 36. To release the lamp 70 from the holder 10, the release member 40 is flexed backwardly by pressing a finger against the wall 54 causing the retainer 58 to disengage from the upper portion 80 and the lamp 70 can be removed. The lamp 70 can be rotated so that light can be aimed towards the ground when the holder 10 is worn on a belt. While the invention has been described with reference to a preferred embodiment thereof, it is to be understood that modifications or variations may be easily made without departing from the scope of the present invention which is defined by the appended claims.

The invention claimed is:

1. A device for attachment to a belt for holding an accessory, comprising:

a) a holder formed as a single piece having a base;

b) said base having a front surface and a back surface;

c) said base having a pair of spaced apart belt receiving slots;

d) said front surface of said base having a right side and a left side;

e) said left side of said base having a first retaining portion extending perpendicularly to said front surface and said first retaining portion having a first sidewall extending therefrom parallel to and spaced from said front surface and forming a first recess;

f) said right side of said base having a second retaining portion extending perpendicularly to said front surface and said second retaining portion having a second sidewall extending therefrom parallel to and spaced from said front surface and forming a second recess;

g) a resilient release member formed as part of said base; and, h) wherein said release member is formed by two arcuate spaced apart slots extending from a top edge of said base and said release member includes a catch and said release member is located below said top edge of said base and said catch extends outwardly from said front surface for engaging an accessory so that the accessory is retained in said holder by said first retaining portion and said second retaining portion and said catch.

2. The device as set forth in claim 1, wherein;

a) said holder is formed of resilient plastic.

3. The device as set forth in claim 1, wherein;

a) said release member includes an L-shaped portion; and, b) said catch is formed on said L-shaped portion.

4. A device for attachment to a belt for holding a light, comprising:

a) a holder having a base;

b) said base having a front surface and a back surface;

c) said base having belt receiving slots;

d) said front surface of said base having a right side and a left side;

e) said left side of said base having a first retaining portion extending perpendicularly to said front surface and said first retaining portion having a first sidewall extending therefrom parallel to and spaced from said front surface and forming a first recess;

f) said right side of said base having a second retaining portion extending perpendicularly to said front surface and said second retaining portion having a second sidewall extending therefrom parallel to and spaced from said front surface and forming a second recess;

g) a resilient release member formed as part of said base; and, h) wherein said release member is formed by two arcuate spaced apart slots extending from a top edge of said base and said release member includes a catch and said release member is located below said top edge of said base and said catch extends outwardly from said front surface for engaging a lamp support base so that the lamp support base is retained in said holder by said first retaining portion and said second retaining portion and said catch.

5. The device as set forth in claim 4, wherein;

a) when the lamp support base is inserted into the first recess and the second recess and the lamp support base slides down and causes the release member to flex backward and when the lamp support base passes the catch, the release member springs forward and the catch slides over a top edge of the lamp support base and the lamp support base is locked from moving vertically by the catch and the lamp support base is locked from moving horizontally and vertically from the holder.

6. The device as set forth in claim 4, wherein;

a) said holder is formed of resilient plastic.

7. The device as set forth in claim 5, wherein;

a) the release member is resilient to release the lamp support base from the holder; and, b) the release member can be flexed backwardly causing the catch to disengage from the top edge and the lamp support base can be removed only by sliding.

8. The device as set forth in claim 5, wherein;

a) said release member includes an L-shaped portion; and, b) said catch is formed on said L-shaped portion.

* * * * *